US007097181B2

(12) United States Patent
Sadow

(10) Patent No.: US 7,097,181 B2
(45) Date of Patent: Aug. 29, 2006

(54) ANGULAR HANDLE ASSEMBLY FOR WHEELED LUGGAGE

(75) Inventor: Bernard D. Sadow, Chappaqua, NY (US)

(73) Assignee: Outrigger, Inc., Chappaqua, NY (US)

( * ) Notice: Subject to any disclaimer, the term of this patent is extended or adjusted under 35 U.S.C. 154(b) by 0 days.

(21) Appl. No.: 11/070,136

(22) Filed: Mar. 1, 2005

(65) Prior Publication Data

US 2005/0173876 A1 Aug. 11, 2005

Related U.S. Application Data

(63) Continuation-in-part of application No. 10/251,584, filed on Sep. 19, 2002, now Pat. No. 6,869,086, which is a continuation-in-part of application No. PCT/US01/47847, filed on Nov. 2, 2001.

(51) Int. Cl.
*B62B 1/00* (2006.01)
*A45C 5/14* (2006.01)

(52) U.S. Cl. ..... 280/37; 280/47.26; 190/18 A

(58) Field of Classification Search ..... 280/47.26, 280/47.371, 47.17, 47.19, 30, 37, 38, 47.315, 280/43.1, 655, 655.1, 47.34; 16/113.1, 335, 16/429; 190/18 A, 115; 403/85
See application file for complete search history.

(56) References Cited

U.S. PATENT DOCUMENTS 4,299,313 A * 11/1981 Null ..... 280/47.26
5,075,925 A * 12/1991 Maloney ..... 16/113.1
5,330,037 A 7/1994 Wang
5,339,934 A 8/1994 Liang
5,377,795 A 1/1995 Berman
5,394,965 A 3/1995 Kho
5,547,053 A 8/1996 Liang
5,615,757 A 4/1997 Chen
5,653,319 A 8/1997 Wang
5,690,196 A 11/1997 Wang
5,693,319 A 12/1997 Tremont
5,706,921 A 1/1998 Wang
5,713,441 A 2/1998 Chen
5,769,194 A 6/1998 Chang
5,868,406 A 2/1999 Sadow
5,943,936 A 8/1999 Deliman et al.
6,129,365 A 10/2000 Sadow
6,237,734 B1 5/2001 Chen
6,409,207 B1 6/2002 Kuo
6,533,086 B1 3/2003 Waddell
6,869,086 B1 * 3/2005 Sadow ..... 280/37

* cited by examiner

*Primary Examiner*—Hau Phan
(74) *Attorney, Agent, or Firm*—Abelman, Frayne & Schwab

(57) ABSTRACT

A wheeled luggage case is provided with a universal pivoting extendable handle assembly that includes a handle that is movable from a protected retracted position in a contoured mounting plate to a fixed angularly rotated position that is about 35° from the vertical in order to minimize the vertical force on the handgrip experienced by users of wide range of heights while towing the luggage. The handle can be provided with one or a pair of telescoping legs and various handgrip configurations.

21 Claims, 10 Drawing Sheets

FIG. 3
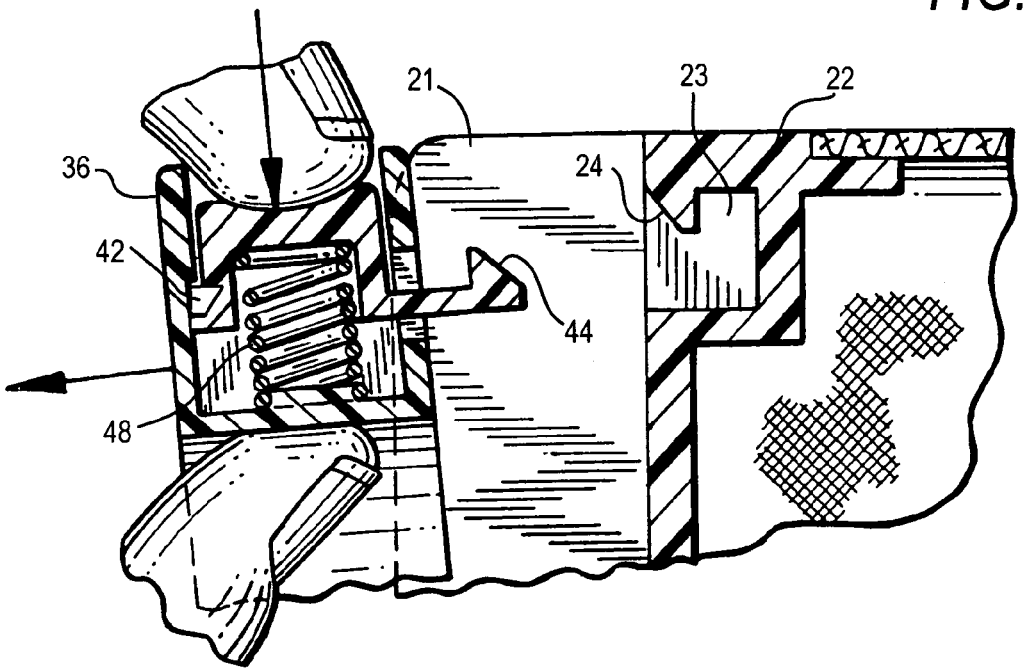
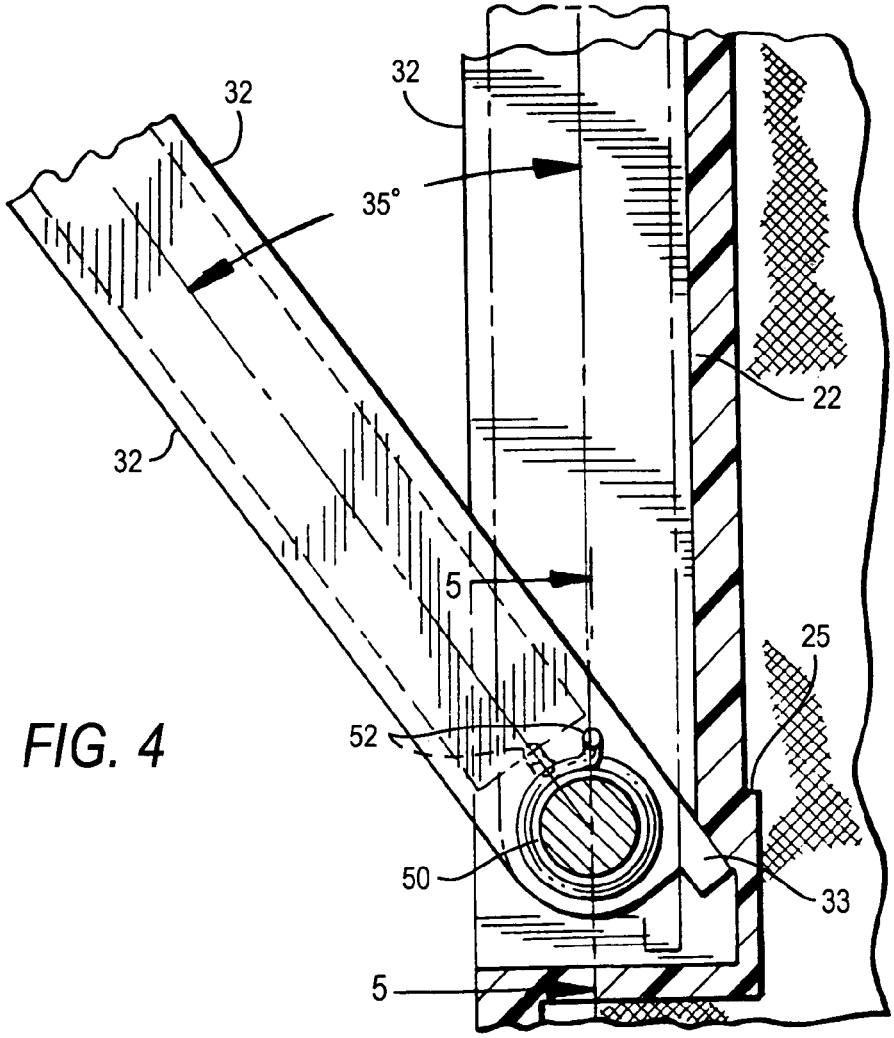
FIG. 4

FIG. 5
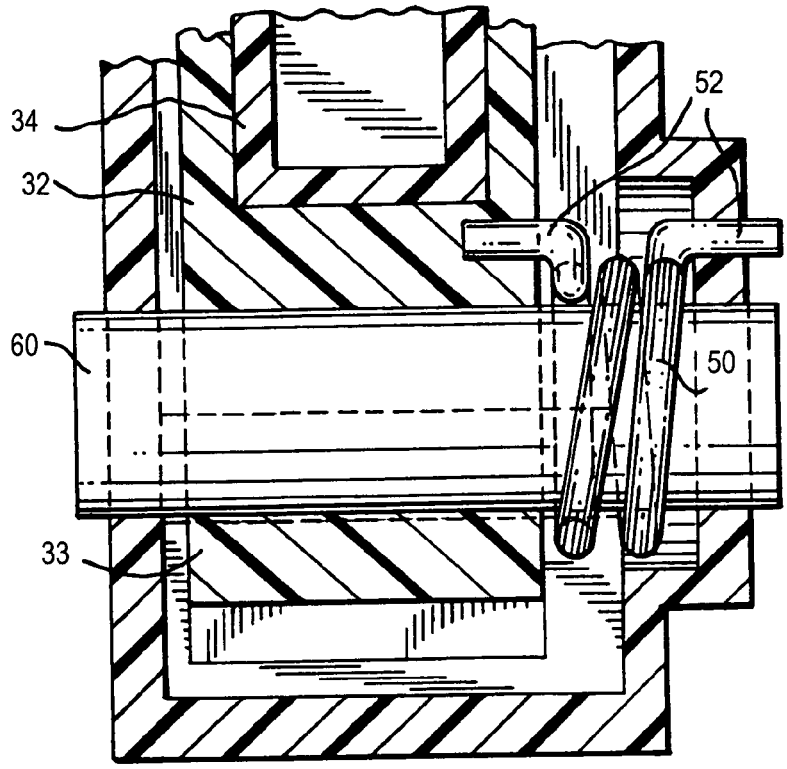
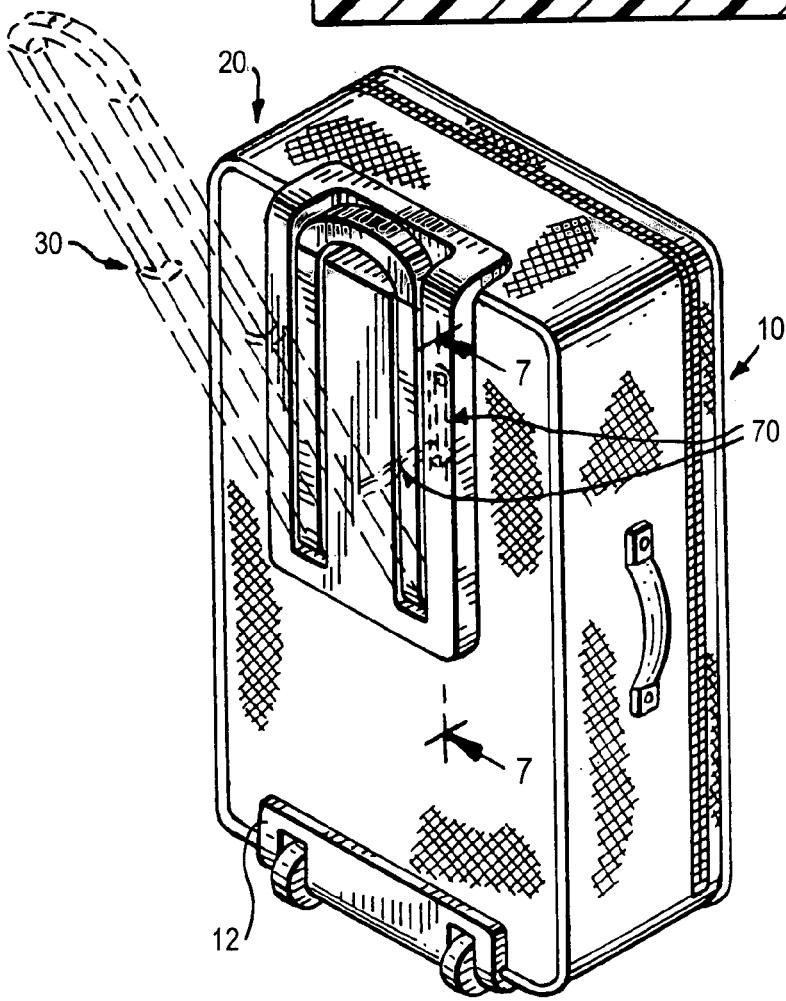
FIG. 6

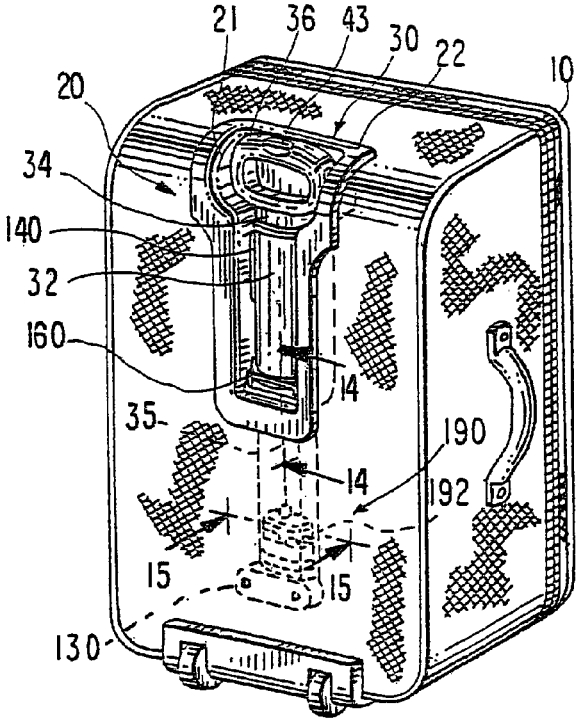
FIG.11
FIG.14
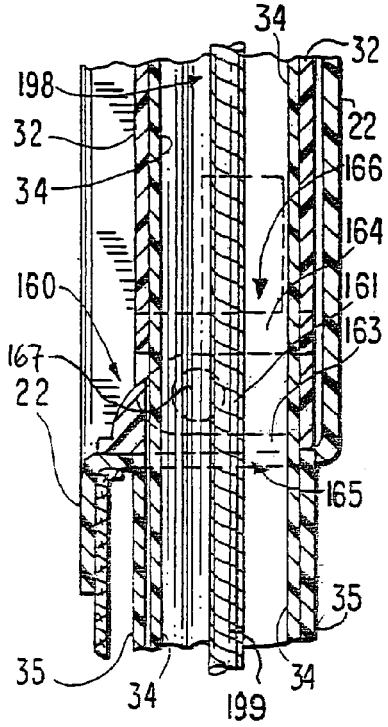
FIG.15
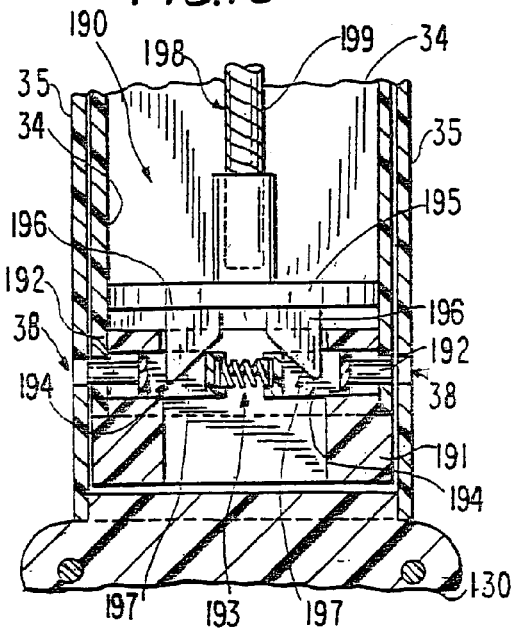

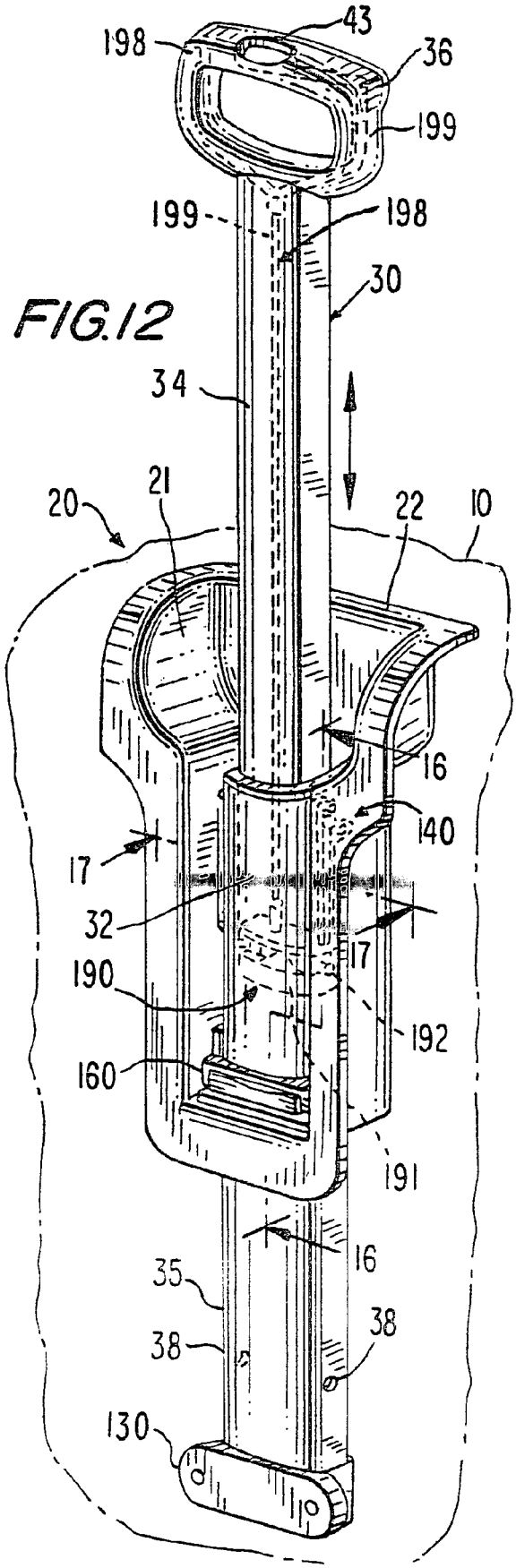
FIG.12
FIG.16
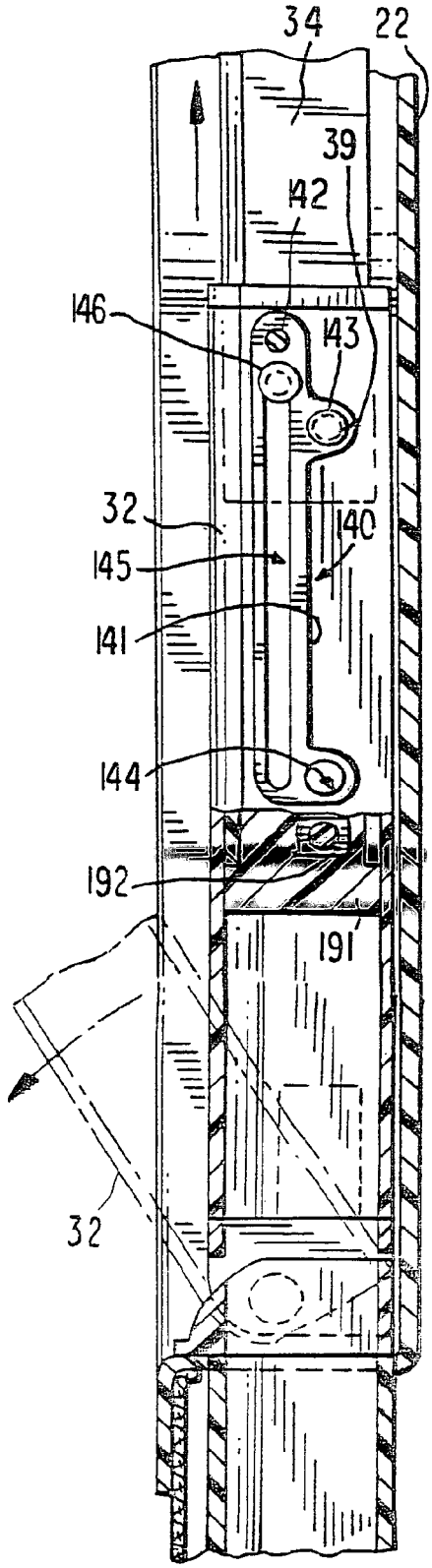

13a
43
13a
90
20
34
30
198
142
141
23
22
10
140
145
145
141
18
192
190
191
18
144
192
32
160
35

190
34
144
22
192
192
144
39
141
32

ANGULAR HANDLE ASSEMBLY FOR WHEELED LUGGAGE

This application is a continuation-in-part of my application Ser. No. 10/251,584, filed Sep. 19, 2002, now U.S. Pat. No. 6,869,086 which is a continuation-in-part of Ser. No. PCT/US01/47847, filed Nov. 2, 2001.

FIELD OF THE INVENTION

This invention relates to wheeled cases and luggage having an extendable handle that pivots from a stowed position that is parallel to the rear wall of the case to tilt the case for towing.

DESCRIPTION OF THE RELATED ART

As used herein, "towed luggage" refers to wheeled cases and luggage of various sizes and styles that are provided with a pivotally-mounted rigid handle that optionally extends and retracts, i.e., it telescopes from a position on, or adjacent to one of the walls, where the wheels or rollers are mounted at the base of, or proximate to the same wall that is adjacent to the handle.

The entire disclosures of my U.S. Pat. Nos. 5,868,406 and 6,129,365 are hereby incorporated herein by reference. Also incorporated herein by reference is the disclosure of my application PCT/US01/47847. U.S. Pat. No. 5,868,406 generally discloses a handle inclined at an angle to the rear wall of the case when the handle is extended with respect to the case and when it is retracted into the case. The handle in the retracted state is received in a housing mounted in the case for guiding and supporting the handle at an angle that is fixed with respect to the rear wall of the case. FIGS. 3, 4, 5 and 6 in U.S. Pat. No. 5,868,406 clearly show the construction of the inclined handle and the housing for supporting and guiding it with respect to the wheeled case.

It has been found that a fixed inclined handle is potentially subject to damage, i.e., bending or possibly even breaking if the case falls on the grip extended end of the handle. My U.S. Pat. No. 6,129,365 generally discloses several embodiments of a handle designed to resist such bending or breakage. These embodiments generally involve dividing the handle into two separate members connected by means allowing rotation between the two members, thus avoiding bending or breakage of the handle.

Despite their obvious advantages, problems and disadvantages are left unalleviated by the improvements disclosed in these two patents. First, since the guiding means for the handle is disposed at the same angle as the angle which the handle makes with the rear wall of the case, the length of the guiding means is limited by the angle which it makes with the rear wall of the case and the distance between the rear wall and the front wall of the case, if it is assumed that the guiding means is contained within the case. This may limit the length of the inclined handle which can be contained within the guiding means, and if such length is too short, use of a telescoping inclined handle becomes necessary. Furthermore, the construction employing a handle extending and retracting from a fixed guide necessitates the modifications of my U.S. Pat. No. 6,129,365, if the potential for bending or breakage is to be avoided or minimized.

It has been recognized in the art that the actual or apparent effort expended by the user of towed luggage can be minimized if the extended handle exerts only a slight downward force on the user's hand and arm during towing of the wheeled case. In U.S. Pat. No. 5,943,936, assigned to Samsonite Corp., a stowable handle is disclosed that can be withdrawn to an intermediate or fully extended position for moving a large case having four supporting wheels. The case itself is not rectilinear and the front and back walls are displaced from the vertical. The portion of the handle legs adjacent the handgrip are curved inwardly with a contour that overlies and conforms to the contour of the top of the luggage.

By permitting the handle to be withdrawn to at least two different lengths, the height of the handle grip above the towing surface can be varied. According to the disclosure of the Samsonite '936 patent, this allows the user to optimize the position based upon the user's height/arm length as well as the weight and load distribution in the wheeled luggage and any attached auxiliary luggage. However, the extendable handle can be moved in only one direction, i.e., parallel to the back wall of the luggage. Depending upon the load and its distribution, the optimum position for the handle grip is very likely to be displaced only a few degrees from a vertical plane passing through the axis of the wheels. Regardless of the height of the handle above the towing surface, this will be a very uncomfortable position for all users during towing because the luggage will be impacting the back of the user's heels, or very nearly so, during a normal pace.

A variety of other mechanisms and constructions have been disclosed for incorporating extended handles and handle assemblies into wheeled luggage. Representative of the prior art constructions is U.S. Pat. No. 5,653,319 disclosing a retractable handle assembly that is vertically extendable from a concealed position in a mounting assembly attached to the back wall of a wheeled case.

A retractable handle assembly is disclosed in U.S. Pat. No. 5,615,757 that is externally mounted on a sidewall of a four-wheeled case that is not tipped for towing. A four-wheeled case is disclosed in U.S. Pat. No. 5,377,795 that can be towed horizontally, or by tipping the case onto a pair of caster wheels, and that has an extendable handle that can be mounted on an exterior wall above the caster wheels, or in supporting tubes inside the case.

Externally mounted retractable handle assemblies are disclosed in U.S. Pat. Nos. 5,339,934 and 5,547,053 that are pivotally joined to a mounting plate for horizontally towing luggage without tipping it.

It will be readily appreciated that all of these embodiments share the characteristic of a breakage-resistant handle. In a situation where the handle is at an inclined angle and the case and the handle fall such that the outermost end of the handle contacts the ground first, the danger of breakage or bending of the handle will be minimized, despite the lack of any deliberate sectioning of the handle as described in my U.S. Pat. No. 6,129,365. This is so simply because the force of any such fall will be transmitted through the handle to the range-limiting means, thus allowing the handle to assume a position parallel to the rear wall of the case and avoid breakage or bending of the handle.

It is therefore an object of this invention to provide a handle assembly from which the handgrip of the towing handle, when extended, optimizes the user's comfort and facilitates towing, by minimizing the vertical force that must be applied to the handle grip to thereby minimize exertion and fatigue.

Another object of the invention is to eliminate any special modifications to the handle to prevent bending or breakage should the case fall on the extended handle.

Another object of the invention is to provide an extendable handle that can be withdrawn from a manually releasable locked storage position on the exterior of the case and adjusted angularly to a predetermined position in order to optimize the towing position for the user by minimizing the force required to tow the case.

Another object of the invention is to provide a handle assembly that is readily adaptable for installation on both hard-sided and soft-sided cases and luggage of various sizes and styles.

A further object of the invention is to provide a handle assembly that can be set at a predetermined angular position after being moved from the stowed position adjacent the rear wall of the case to the towing position.

It is also an object of the invention to provide a handle assembly that can be installed on either the exterior or interior rear wall of a case or luggage.

Another object of the invention to provide a handle that can be set at a fixed angle with respect to the rear wall of the case, and which will rotate in response to the force of an impact if the case falls on the extended handle, thereby avoiding bending or breaking.

SUMMARY OF THE INVENTION

The above objects and other benefits and advantages are achieved by the present invention which comprises a pivoting handle assembly for use with a wheeled case or other wheeled luggage that is tilted by the user for touring. The handle assembly stores the retracted handle in a stowed position parallel to the rear wall of the case and permits the pivotal displacement of the extended handle to at least one fixed position that is at a predetermined angle to the rear wall of the case.

One preferred embodiment of the pivoting handle assembly of the invention includes:

- a handle having at least one rigid leg joined at one end to a transverse handgrip, the at least one leg being pivotally movable between a first stowed position(s) and a second, angularly displaced towing position "T",
- a mounting plate for receiving and retaining the handle in pivotally-mounted relation, the mounting plate adapted for mounting the handle for access from the exterior of the case;
- pivotal mounting means joining a portion of the handle to the mounting plate; and
- at least one range-limiting means operatively engaging the mounting plate and the handle, whereby the angle defined by the at least one leg of the handle and the mounting plate is fixed when the handle is in the towing position.

The handle can comprise two legs in the form of tubes pivotally mounted on the mounting plate and a handgrip joining the free ends of the legs. This U-shaped handle is preferably telescoping so that the handle can be extended for use and retracted for stowing. The U-shaped handle is held in its fixed angular position by range-limiting means that releasably lock into position. The handle is returned to a stowed position in the contoured mounting plate on the back of the case by manually releasing the range-limiting means.

In a second embodiment of the invention, the handgrip is T-shaped or L-shaped and can be rotatably mounted at the free end of a single leg, thereby allowing the user to manually rotate the handle to a desired or predetermined position during towing of the case. In any event, it will be understood that the mounting plate is appropriately contoured to receive the retracted handle leg or legs and handgrip.

In a third embodiment of the invention, the handle assembly includes a mounting plate and a telescoping handle. The mounting plate is affixed to the rear wall of the case above the wheels. The handle includes at least one exterior housing member that encloses an extendable leg member having a handgrip on its upper end. In the retracted or stowed position the lower end of the extendable leg is covered by an interior housing member mounted on the inside rear wall of the case. The exterior housing member is pivotally mounted to the mounting plate at its lower end. In a preferred embodiment, the handle can be tilted when the leg is withdrawn from the stowed position with lower end of the leg inside the exterior housing member. A range-limiting member is rotatably connected to the mounting plate and slidingly connected to the upper portion of the exterior housing member. The range-limiting member includes a slot that limits the pivotal travel of the upper portion of the exterior housing member and the extended leg member to a predetermined angle.

This third embodiment of the pivoting handle assembly of the invention can include:

A pivoting handle assembly for use with a towed wheeled luggage case, the assembly comprising:

- a mounting plate for receiving and retaining a handle, the mounting plate adapted for attachment to a wall of the case above the wheels;
- the handle including an exterior housing member and an extendable leg member slidingly supported by and extending through the exterior housing member in a stowed position, the leg member terminating in a handgrip;
- pivotal mounting means connected to a lower end of the exterior housing member, the pivotal mounting means being secured to the mounting plate, whereby the exterior housing member and the leg member are rotatable about the mounting means between a stowed position and an angularly displaced towing position,
- at least one range-limiting device operatively joined to and extending between the mounting plate and the exterior housing member, wherein
- the angle between the handle and case wall when the handle is in the towing position is determined by the range-limiting means.

It has been found in the course of various experiments and tests with prototype constructions embodying the invention, that a relatively narrow range of angular displacement, e.g., from the vertical, will allow a large majority of users to comfortably tow different sizes of wheeled luggage. This finding applies to a group of users whose height varied considerably from about five feet to well over six feet. This is a surprising finding, since it has long been assumed that the reasonably comfortable hand position for a tall user who was well above the mean or average male height of 5'-9", would be significantly different than that of a shorter user of a height well below the mean height.

Thus, what has been found is that for users within a broad range of heights, that when the hand is extended rearwardly in the towing position, the vertical distance between the hand and the floor are substantially the same. From this determination, it has further been found that there is a limited range of angular displacement which creates a greatly improved, if not optimum center of gravity position that maximizes comfort and minimizes effort and strain during towing. This finding applies to luggage that is packed; to luggage packed and supporting another piece on the top; or to luggage packed and carrying an accessory on a strap that shifts the weight to the vertical wall opposite the extendable handle.

In an especially preferred embodiment of the invention, the extended handle is angularly rotatable to a towing position that is displaced about 32 degrees to 38 degrees from the vertical. In a most preferred embodiment, the towing position is about 35 degrees from the vertical.

When the handle is moved to the predetermined position of angular displacement with respect to its stowed position, the range-limiting means provides a sufficiently secure engagement to maintain the handle at this predetermined angle in resistance to those forces that are anticipated during normal towing of the case, including movement of the case across rough paving, over curbs and up and down staircases. However, should the case inadvertently be allowed to fall over on the extended tilted handle, the range-limiting means will be dislodged or disengaged by the force of impact and cause the handle to rotate back in the direction of the rear wall of the case, thereby avoiding any bending or other damage to the handle assembly or the range-limiting means.

BRIEF DESCRIPTION OF THE DRAWINGS

The invention will be apparent to those of ordinary skill in the art upon consideration of the following description of the preferred embodiments and the attached drawings in which like elements are referred to by the same number, and in which:

FIG. 3 is a detailed cross-sectional view illustrating the manual operation of the release mechanism of FIG. 2;

FIG. 4 is a cross-sectional view, partly in phantom, taken along lines 4—4 of FIG. 1 and illustrating the angle of the handle relative to the back wall in the towing position;

FIG. 5 is a cross-sectional view illustrating one embodiment of a release mechanism that will permit movement upon an impact force applied to the extended handle;

FIG. 6 is a top, rear and side perspective view of a wheeled case illustrating another embodiment of the invention;

FIG. 11 is a top, rear and side perspective view, partly in phantom, of a wheeled case illustrating another embodiment of the invention showing the handle assembly in a stowed position;

FIG. 12 is an enlarged view, artly in phantom, of the handle assembly of FIG. 11 in an intermediate position;

FIG. 14 is a side elevation cross-sectional view, partly in phantom, taken along lines 14—14 of FIG. 11 illustrating the lower portion of the exterior housing member of the handle assembly;

FIG. 15 is a rear elevation partial cross-sectional view taken along lines 15—15 of FIG. 11 illustrating one embodiment of a locking mechanism for the stowed handle;

FIG. 16 is a side elevation cross-sectional view, partly in phantom, taken along lines 16—16 of FIG. 12;

DESCRIPTION OF THE PREFERRED EMBODIMENTS

Figure 1:
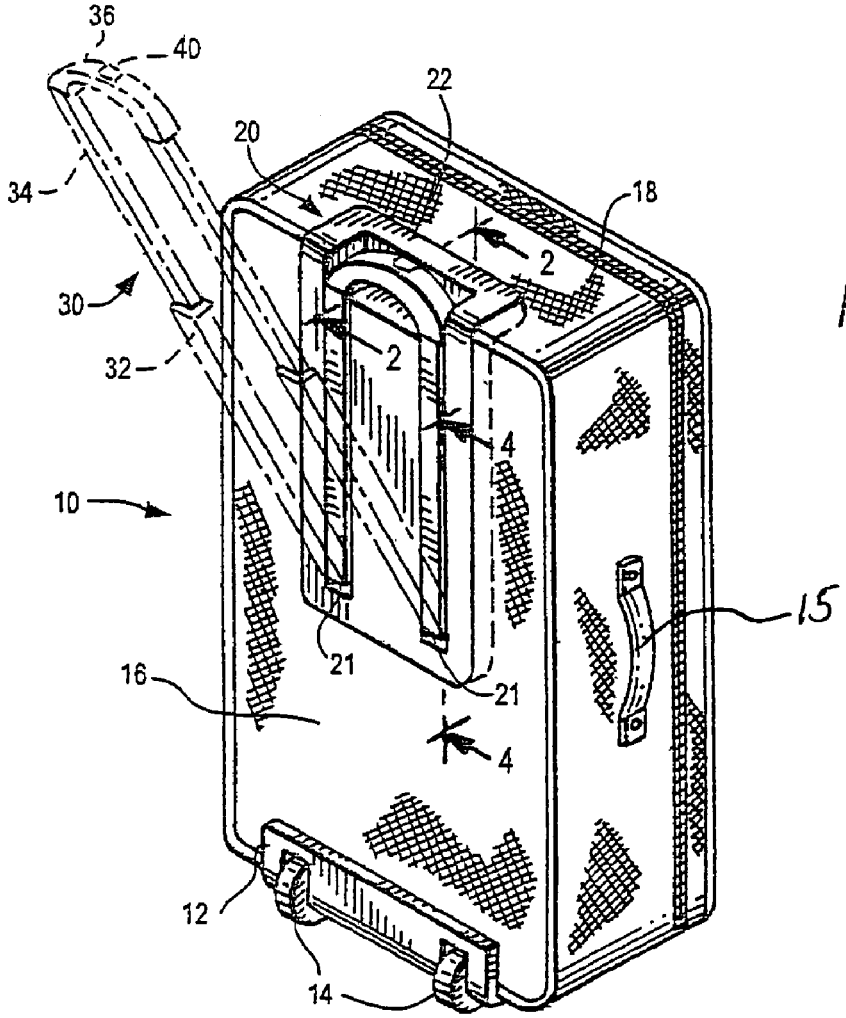
FIG. 1 is a top, rear and side perspective view of a wheeled case illustrating one embodiment of the invention, showing the extended handle in phantom.

With reference to FIG. 1, there is illustrated an article of wheeled luggage or case 10, fitted with a wheel assembly 12, comprising a pair of wheels 14 attached to the junction of the back 16 and a sidewall 18 of the case. The case 10 can be fabricated from rigid materials, including polymers, metal and/or composites, all of which are well known in the art; or from fabrics such as woven nylon attached to a supporting frame work. The case can be provided with a manual carrying handle 15, on one or more of the sidewalls. The wheels 14 can be replaced by one or more rollers (not shown). The construction of the case or luggage can be in any manner known to the prior art, or that may be subsequently developed.

With continuing reference to FIG. 1, pivoting handle assembly 20 of the invention is shown secured to the back 16 and upper side wall 18 opposite the wheel assembly 12. The pivoting handle assembly 20 can be constructed from metal, or, preferably, from a combination of molded polymeric and metal elements. The assembly 20 comprises a handle 30 and a mounting plate 22 for receiving and retaining the handle in a pivotally-mounted relation.

As shown in the illustrative example of FIG. 1, the handle is generally U-shaped and is comprised of a pair of optionally telescoping legs 32 joined at one end to a transverse handgrip 36. The handle is pivotally moveable between a first stowed position and a second, angularly displaced tilted position "T".

The generally U-shaped handle 30 is stowed in a corresponding recess 21 in mounting plate 22 which is adapted to receive the handle in secure engagement in the stowed position and to protect the handle 30 while the bag is in being carried by handle 15 or in the care of the airline of other transportation service provider. Thus, the configuration of the mounting plate 22 and its receiving recess 21 serves to isolate the handle from impact from other pieces of luggage, luggage conveying systems, and the occasional rough handling experienced during transport.

Figure 1A:
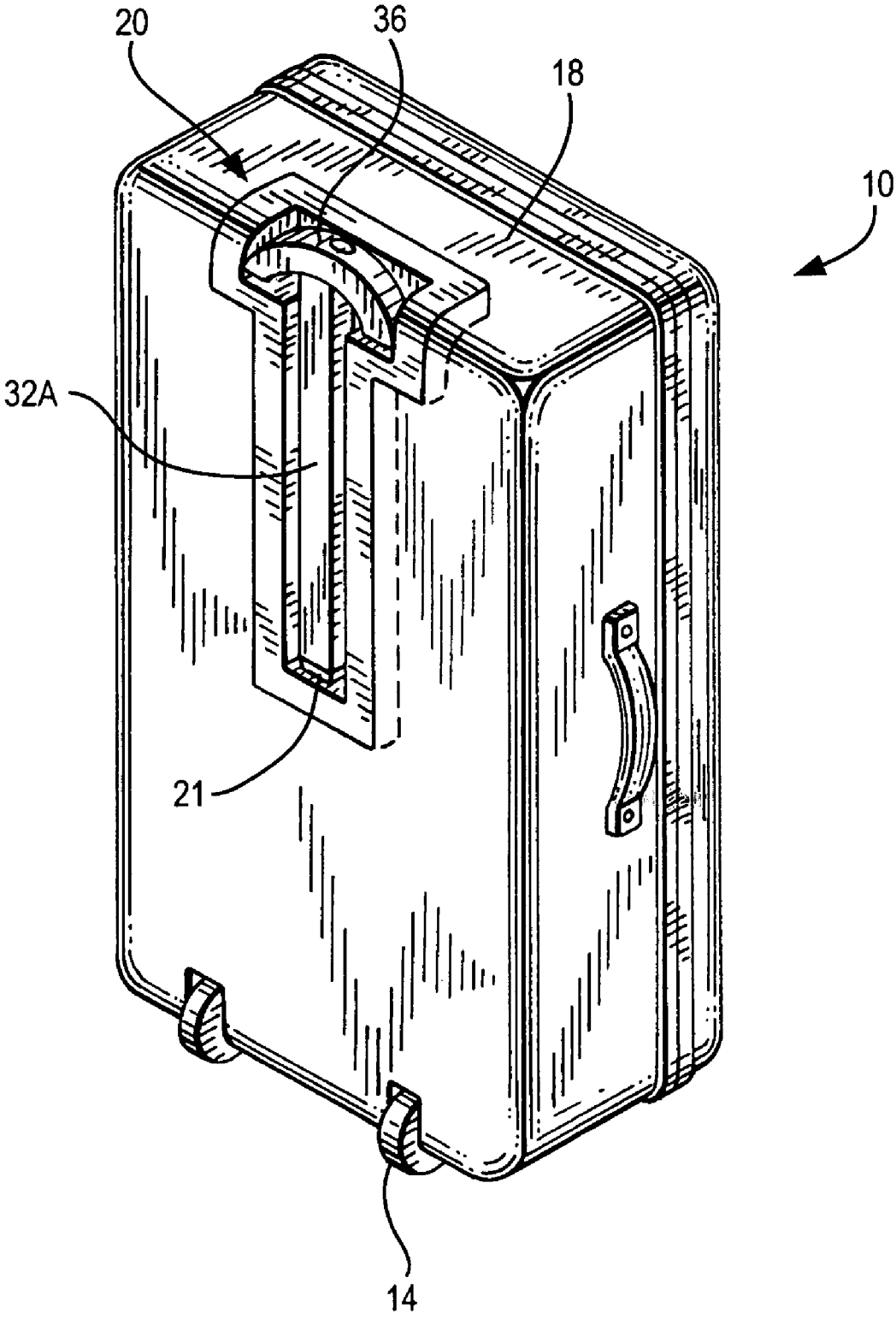
FIG. 1A is a view similar to FIG. 1 showing a case with an alternate style of handle.

As will also be understood by one of ordinary skill in the art, the towing handle 30 can comprise a single leg with a handgrip 36 that defines a generally D-shaped or L-shaped or T-shaped configuration 32A, e.g., as shown in FIG. 1A. In this construction, the mounting plate will have a corresponding T-shaped or L-shaped recess to similarly receive the single-legged handle in a pivoting relation. If desired, the handgrip can be rotationally mounted on the free end of the leg.

Depending upon the height of the case in the towed position, it may be desirable to include a telescoping leg member 34 that is received in the exterior leg member 32 in sliding relation. The construction of telescoping towing handles is well-known in the art and does not constitute a specific feature of this invention. Any of the constructions and release mechanisms known to the prior art, or subsequently developed, can be employed in the practice of the present invention.

If the case is unusually large in the longitudinal dimension i.e., from the wheel assembly 12 to opposing wall 18, a non-telescoping handle can be efficiently utilized.

Figure 2:
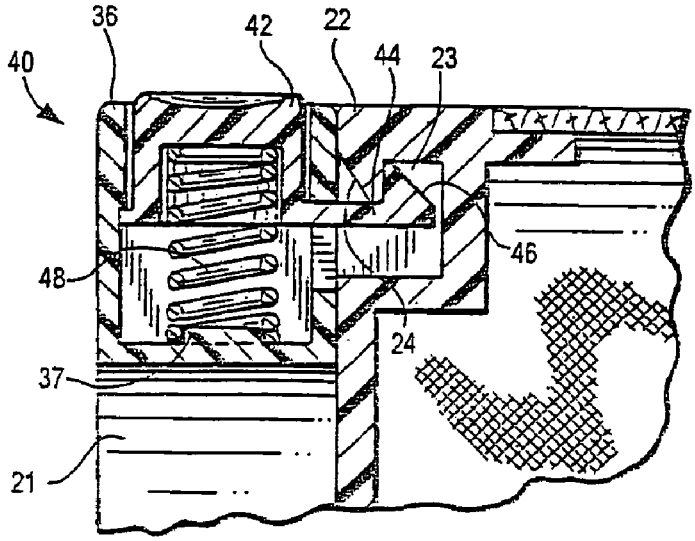
FIG. 2 is a detailed cross-sectional view taken along lines 2—2 of FIG. 1.

With continuing reference to FIG. 1 and in conjunction with FIGS. 2 and 3, it will be seen that the handgrip 36 is provided with a manually-actuated release member 40 to disengage a lock member which secures the handle in the stowed position. As best shown in FIGS. 2 and 3, a release button 42 is depressed against the biasing force of spring 48 to disengage hasp 46 from retaining element 23, which is advantageously integrally molded into a locking recess in the upper portion of mounting plate 22. The locking member 46 is joined to the release by arm 44, and upon the depression of release button 42 the handgrip and legs can be withdrawn from recess 21 to at least one fixed towing position.

In the preferred embodiment of the invention, the handle forms an angle of about 35° to the vertical when the handle is extended and before the case has been tipped for towing. This relationship is clearly indicated in the illustrations of the embodiments depicted in FIGS. 4 and 10.

In another embodiment, (not shown), a second fixed angular towing position is provided to accommodate users whose stature or other particular physical requirements will render an alternative towing position more comfortable.

The handle assembly can be mounted entirely on the exterior surface of the back wall, or its exterior surface can be flush with that of the back wall. In the latter construction, the assembly will project into the interior cargo space of the case. The handle assembly is secured to interior frame members of the luggage case in accordance with methods and structures well known in the art. For example, threaded fasteners, rivets and adhesives can be employed. The rear and/or sides of mounting plate can be provided with grooves and recesses to receive frame members of the case (not shown).

In a preferred embodiment, the handle assembly 20 extends partially into the interior of the case and its outer surface is flush with, or alternatively, projects somewhat above the surface of the back wall 16 and side wall 18. For example as illustrated in FIGS. 1 and 6, the exterior surface of assembly 20 and wheel assembly 12 project the same distance above the surface of back wall 16 to provide a flat supporting surface when the case is positioned for access.

With reference to FIGS. 4 and 5, there is illustrated one preferred embodiment for mounting the leg members in pivoting relation to the mounting plate. A pivot pin or axle 60 is received in a corresponding aperture in the lower portion of leg 32. Torsion coil spring 50 is mounted on pivot pin 60 with its terminal end member parallel to the axis of pin 60. One of opposing end members 52 engages a portion of leg 32 and the other end member 52 engages a portion of the adjacent mounting plate 22. When the handle 30 is in the stowed position, a torsional force is applied tending to push the handle to the angular towing position. As most clearly shown in FIG. 4, the lower portion of handle 32 is formed with a stop member 33 that contacts engagement surface 25 formed in a proximate portion of mounting plate 22. The configuration of stop 33 and engagement surface 25 is adapted to allow the handle 30 to move to a position of about 35° from the vertical or stowed position. The torsional force of spring 50 is sufficient to maintain the handle at the 35 degree angle towing position, while also allowing the user to press the handle into the stowed position against its force.

In a preferred embodiment, torsion springs 50 are mounted on the pivot pins 60 at the base of both legs of a U-shaped handle. Alternatively, a single spring having the required characteristics can be employed. Where a single leg is used in the construction of the T-shaped or L-shaped handle, a single spring can be used or, alternatively, a pair of torsion springs mounted on either side of the single leg in appropriately configured recesses.

Referring again to FIG. 3, it will be understood that when the handle is pivotally rotated towards the case, the inclined surface of lock hasp 44 will slidingly contact the correspondingly inclined surface 24 allowing the lock member to enter recess 23 and mounting plate 22. When completely inserted, the hasp will engage the depending member to secure the handle in position in the recess against the torsional force applied to one or both legs by the torsional spring 50.

As will be apparent to one of ordinary skill in the art, various other locking means and lock configurations can be employed for retaining the handle in the stowed position. For example, the spring-loaded release button 42 and hasp 44 can be located on the mounting plate so that the hasp will engage an appropriately configured opening on the side or bottom wall of the handgrip 36 as it is pivotally rotated into the stowed position.

A lock mechanism can also be incorporated into the mounting plate 22 to releasably engage one or both leg members 32 when the handle 30 is moved to the vertical position, and, optionally, before the leg(s) 34 are retracted to lower handgrip 36. Any of a variety of other lock and release mechanisms that are well known in the art can be employed.

In a further preferred embodiment, a manually activated positive release means is operatively connected to the range-limiting means to facilitate the movement of the handle from the towing position to the stowed position. The positive release means can be activated by movement of a spring-biased push button release bar, release lever, or the like. The push button or other device that is used to activate the release mechanism can be positioned on the handgrip 36 or on the mounting plate 22. The release will preferably take the form of an elongated inextensible member or assembly that will transmit to manual force of the user's finger(s) or thumb to the range-limiting means.

The release mechanism can comprise a release cable or wire rope, one or more linked rods or bars, bellcranks carried in a tube and/or over pulleys, a series of levers and pivot pins, or a combination of these mechanical elements.

In the embodiment utilizing a torsion spring, as is illustrated in FIGS. 4 and 5, one end 52 of the spring 50 can be supported by a moveable contact member that is joined to one end of a release cable, the opposite end of the cable being secured to a release push button located on the handgrip 36. When it is desired to move the handle 30 from the pivotally extended towing position to the stowed position, the release button is depressed, causing the release cable to move the contact plate and thereby reducing the effective force of the spring to facilitate manual movement of the pivoting handle.

In the embodiment of the stop-locking hinge described above, and particularly with reference to FIG. 9, a release cable, bar or lever is operatively connected to hinge plate 72.

When depressed, the release button extends the release mechanism to lift the hinge plate from the extended locked position. This reduces the force required to return the handle to the stowed position.

As will be apparent to those of ordinary skill in the art, numerous other manually operable release mechanisms can be employed in the construction of the assembly of the invention. A variety of such mechanisms have been disclosed and commercialized by the art in positive release and locking mechanisms for extending and retracting telescoping handles. The push button or bar is commonly located in the handgrip and when depressed, causes movement of a pin or ball catch or other equivalent mechanism, that permits relative movement of the handle members.

Figure 7:
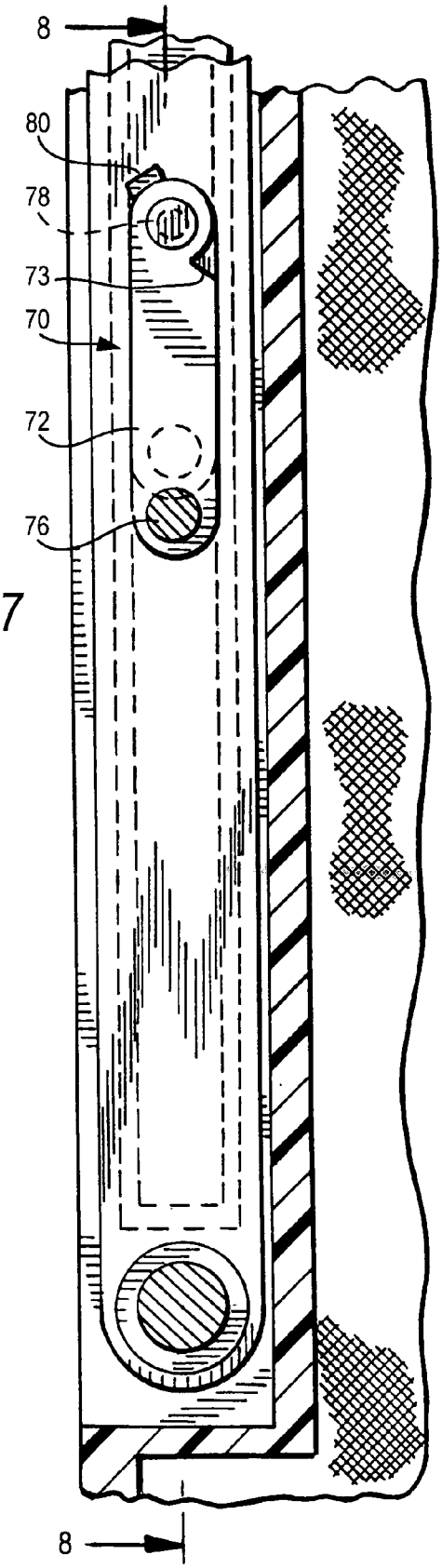
FIG. 7 is a side elevation detail view partly in section, of the retaining mechanism, shown partly in phantom in FIG. 6, taken along line 7—7 of FIG. 6.
Figure 8:
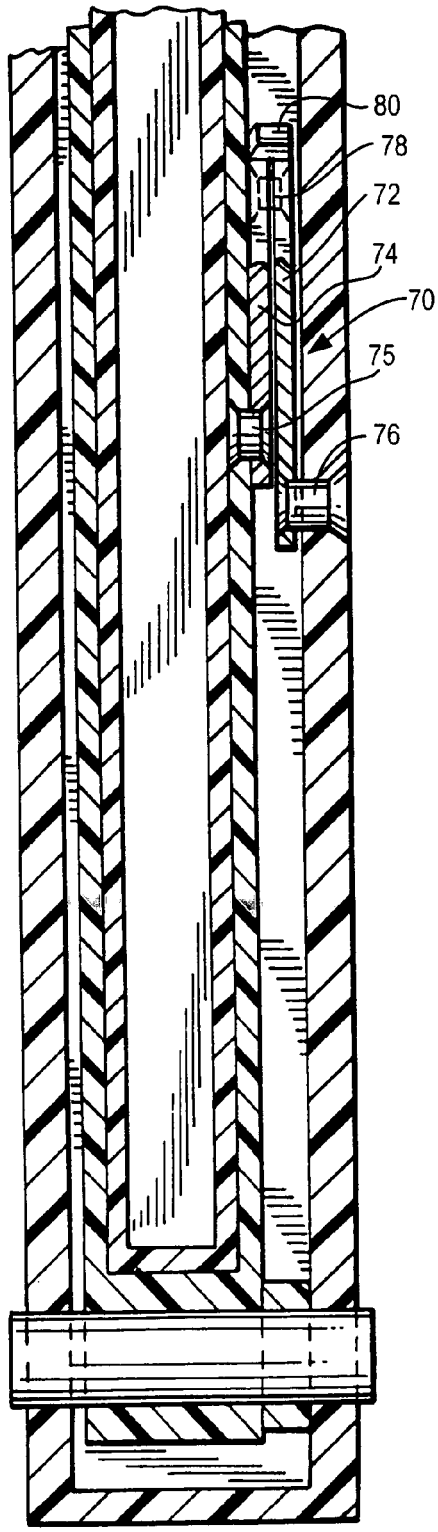
FIG. 8 is a cross-sectional view taken along line 8—8 of FIG. 7.
Figure 9:
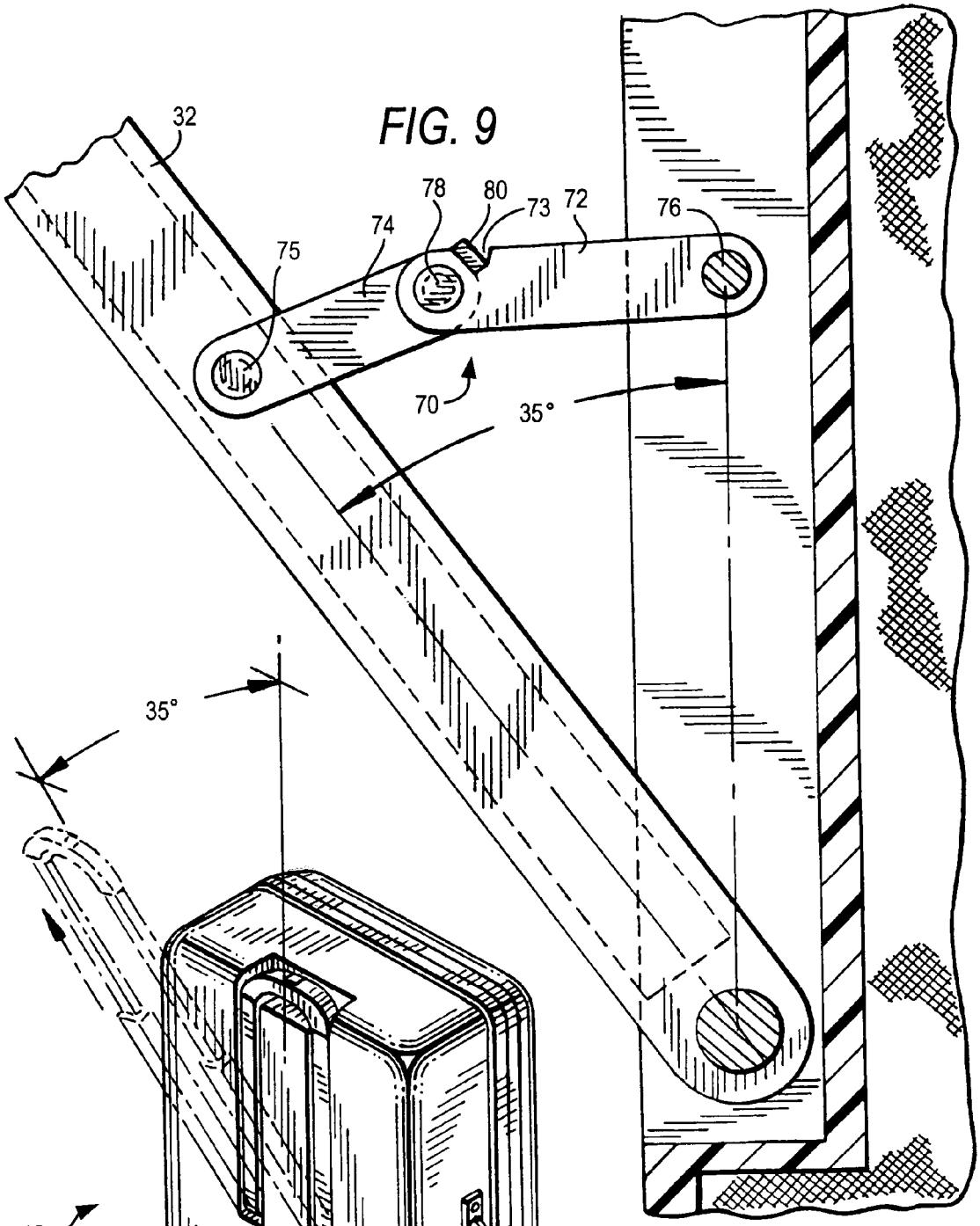
FIG. 9 is a view similar to FIG. 7 showing the retaining mechanism with the handle in the towing position.
Figure 10:
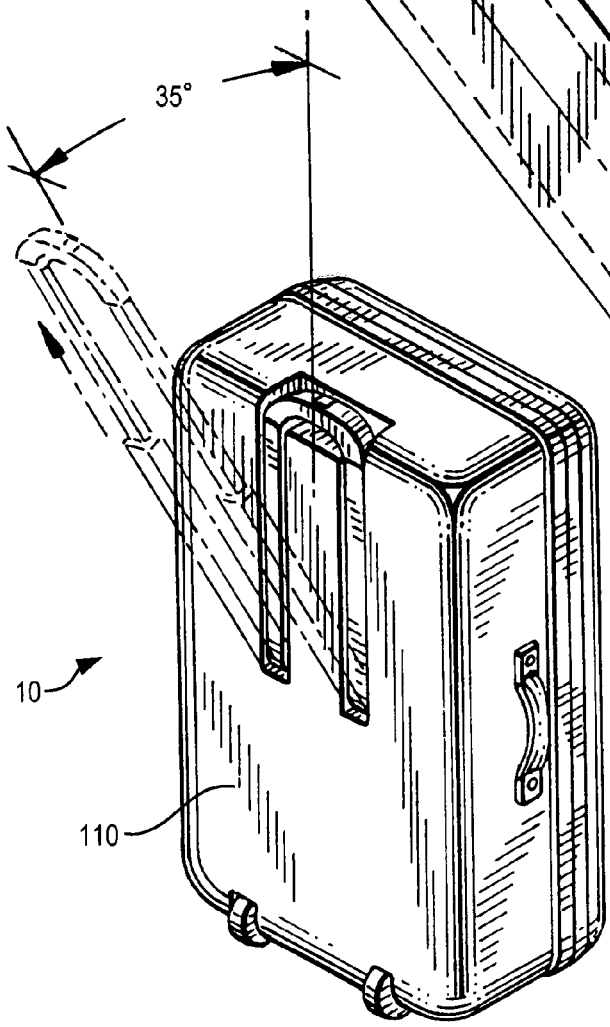
FIG. 10 is a view of a molded luggage case embodying the invention.

With reference to FIGS. 6–10, an alternative means for limiting the range of movement of the pivoting handle 30 is illustrated. As shown in phantom in FIG. 6, when the handle is drawn from the stowed position in the mounting plate 22, range-limiting locking hinge 70 retains the handle at an angle that is preferably about 35° from the vertical. This angular relationship is also shown in FIGS. 9 and 10.

The arrangement and construction of the locking hinge will be described in more detail with reference to FIGS. 7–9. Referring to FIG. 7, locking hinge 70 is attached at one end to leg 32 and at its opposite end to mounting plate 22 by appropriate fasteners 75, 76, which can be rivets. The pivot pin 78 secures arms 72 and 74 together.

Lock bar 80 extends from arm 74 and in the fully extended position engages groove 73 in arm 72. As can be seen from FIG. 9, the arms 72 and 74 form an obtuse angle in the extended, locked position, retaining handle 32 at an angle this is preferably about 35° from the vertical.

In the event that the case were inadvertently to fall backwards on the extended handle 30, the force on the handle would forcibly disengage the lock bar 80 from groove 73. The initial locking engagement is sufficient to prevent disengagement during normal towing. The locking engagement can include an assembly with resilient members that are reversibly deformed upon impact, and the use of spring-biased ball catches and/or rotating spring-loaded friction plates or clutches.

From the above description, it will be apparent that the resistance to damage from impact of the handle assembly of the invention is a major advantage.

As will be apparent to one of ordinary skill in the mechanical arts, other constructions can be employed to move the handle to the desired fixed position and releasably retain it there until the user or an unexpected impact of predetermined minimum force cause its movement towards the back wall of the case. For example, the range-limiting means can comprise a spring-loaded pneumatic cylinder attached at one end to one or both of the handle legs and, at the other end, to the mounting plate. When the handle lock member is released, the force of the spring moves an internal cylinder and rod against the pneumatic pressure in the cylinder to extend the handle to the predetermined preferred angular position of 35° . The piston has an internal pressure-sensitive release valve that opens when a predetermined force is imposed, as when the user wishes to return the handle to the stowed position, or when the case is inadvertently allowed to fall on the extended handle. Various other slide arms and levers with spring-loaded or biased ball and detent catches and/or friction plates can be employed as the range-limiting means.

Furthermore, the pivot pin or pins 60 through handle legs can be displaced from the end so that the portion of the legs 32 below the pivot axis can receive a force to move the handle angularly from the stowed position and maintain it in the towing position. One or more coil springs in compression in the stowed position are secured between the mounting plate and the free end of the leg below the pivot axis to rotate the handgrip 36 away from the backwall 16.

Another embodiment of the invention is illustrated in FIG. 10, where the lower cargo-carrying portion 110 of the case 10 is molded or otherwise formed as a unitary element. In this embodiment the range-limiting means is not shown with the phantom handle in the interest of simplifying the depiction. In the context of the above description of the invention, the mounting plate 22 subsumes the entire lower portion 110 of the molded case 10. Thus, as used in the appended claims, it is to be understood that the definition of the mounting plate is intended to encompass the lower portion of rigid molded or formed luggage and cases.

Furthermore, it should be understood that the first embodiment of the invention showing a mounting plate for receiving and supporting the handle extending only partially down the back wall of the case is by no means a requirement, and that the mounting plate can extend further down the case, i.e., for the entire length of the wall adjacent to which it is positioned, thereby optionally eliminating the need for a telescoping handle, or handles of greater length. The use of a longer mounting plate can include tube(s) or channel(s) from which the handle is withdrawn from the stowed position to the towing position, at which the handle's vertical movement is stopped and is rotated arcuately to the predetermined inclined position.

Furthermore, it should be noted that inclined handles such as those disclosed above, and in my previously mentioned United States patents, have the general advantage of keeping the case further from the body of the user given the position of the hand of the user in towing the case, than would be possible if the handle extended parallel to the rear wall of the case. This will have the beneficial result of preventing the case from colliding with the user's heel when the case is towed behind the user, which can frequently happen with a conventional handle extended parallel to the rear wall of the case. Thus, it will be apparent that the inclined handle cases of the present invention require a user to exert less vertical or supporting force on the handle to keep the case at a particular angle of tilt as compared to a case in which the extended handle is parallel to the rear wall.

With reference to FIG. 11, another preferred embodiment for limiting the range of movement of a pivoting handle assembly for a tiltable towed case is illustrated in a first stowed position. Handle assembly 20 includes a mounting plate 22 and a handle 30 that is constructed to permit portions of handle 30 to be movable between the first stowed position and a second angularly displaced tilted position for towing. The preferred materials of construction of handle assembly 20 include molded polymeric compounds and metal.

Mounting plate 22 is secured to case 10 and defines a recess 21 that receives portions of handle 30 in the first stowed position. In one preferred embodiment, recess 21 provides a gap between mounting plate 22 and handgrip 36 to permit the handgrip to be grasped while it is in the stowed position. Mounting plate 22 also includes a lower mounting bracket 130 that is preferably positioned and connected to the interior wall of case 10.

As shown in FIGS. 11 and 12, handle 30 in the first stowed position extends between mounting plate 22 and lower mounting bracket 130. Handle 30 includes an exterior housing member 32, interior housing member 35, a sliding leg member 34 and a range-limiting device 140. Exterior housing member 32 and interior housing member 35 receive leg 34 in sliding relation for movement between the stowed position and the angularly displaced positions.

Interior housing member 35 is connected on opposing ends to a joint 160 and lower mounting bracket 130. Exterior housing member 32 is connected to joint 160 on one end and defines an aperture on the opposing end for receiving leg member 34. Range-limiting device 140 is preferably connected in proximity to the opposing end of exterior member 32. In the stowed position, exterior member 32 and interior member 35 are coaxial and aligned with a vertical axis. Exterior member 32 and interior member 35 can include joint 160. Joint 160 is connected to mounting plate 22.

Leg member 34 can have a length defined by the distance between mounting plate 22 and bracket 130, and preferably extends into interior housing 35 to provide a securely stowed and locked position. Leg member 34 includes a handgrip 36 and a locking mechanism 190 to secure it to engagement means in member 35 when handle assembly 20 is in the stowed position.

Handgrip 36 includes a release button 43 that engages and disengages locking mechanism 190. In the stowed position, button 43 is in the extended position and detents 192 engage apertures 38 in housing member 35 to lock handle assembly 20 in the first stowed position. Depressing release button 43 disengages detents 192 from apertures 38 permitting leg 34 to slide up to an upper limit of travel in exterior housing member 32. Locking mechanism 190, as defined herein, can have a plurality of apertures corresponding to lockable intermediate positions along the axes of members 32, joint 160 and member 35 for receiving detents 192 and locking leg 34 in a desired position.

Referring now to FIG. 12, an intermediate position of handle assembly 20 is shown with leg member 34 is extended from the stowed position and locked with the tubular wall of exterior housing member 32 and range-limiting device 140. In the first stowed position and the intermediate position, exterior housing member 32 and leg member 34 are aligned along a single axis and locked in fixed spaced relation to mounting plate 22 and case 10.

Figure 13:
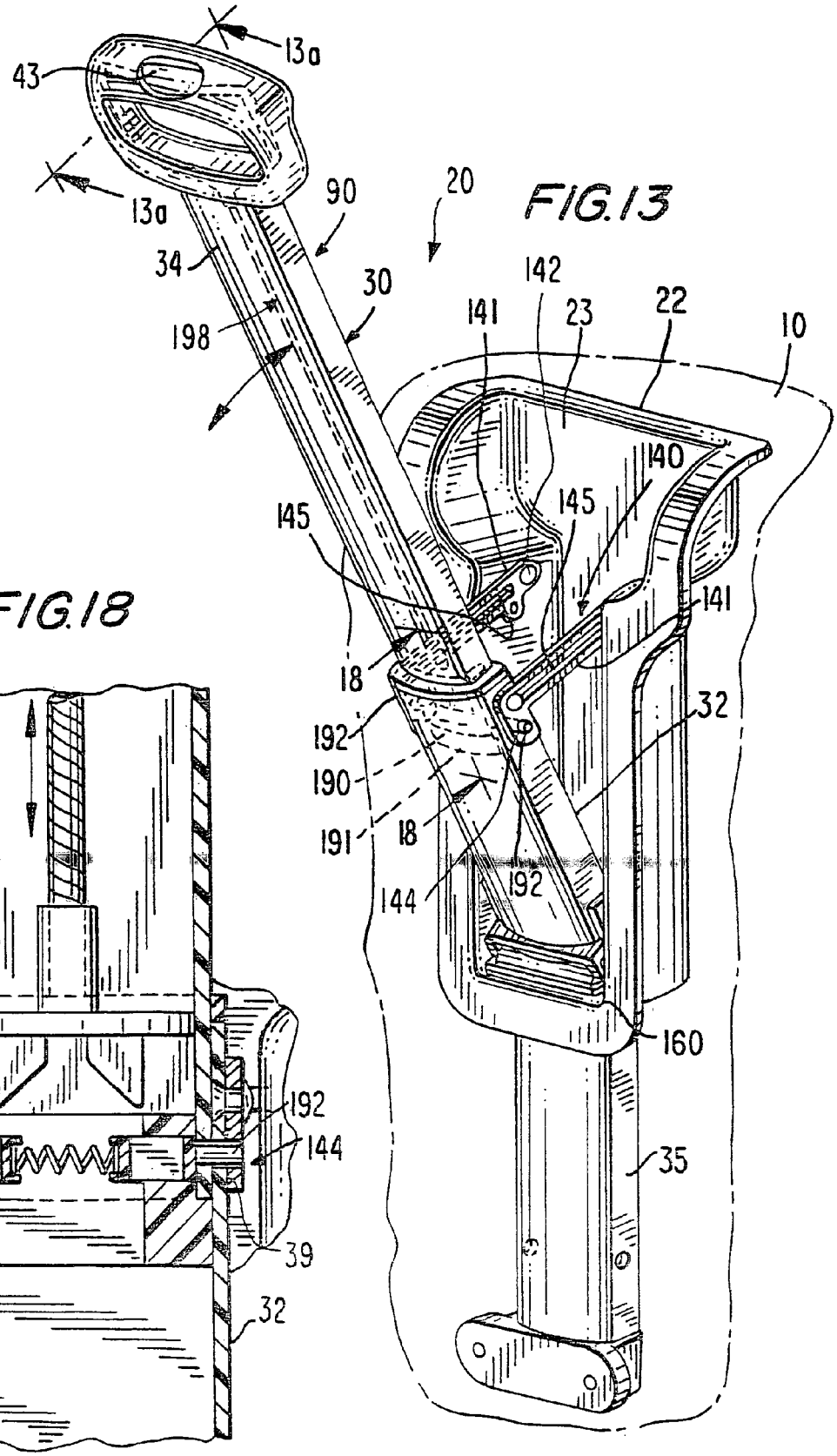
FIG. 13 is an enlarged view of the handle assembly of FIG. 11 in an angularly displaced and locked position.

As shown in FIGS. 12 and 13, handle 30 includes a rotatable portion 90 that pivotally rotates about joint 160 between the intermediate position and the second, angularly displaced tilted position approximately 35° rearward from the intermediate position. Rotatable portion 90 includes leg 34, exterior housing member 32, range-limiting device 140 and joint 160.

Range limiting device 140 is rotatably connected to mounting plate 22 and is preferably positioned on opposing sides of, and in sliding engage with exterior housing 32 to limit the pivotal rotation of extended handle assembly 20 about joint 160.

Range-limiting device 140 in the preferred embodiment illustrated comprises a pair of elongated slide plates 141 positioned on opposing sides of exterior housing member 32 that limit the angular travel of rotatable portion 90. Each side plate 141 is preferably connected at one end to mounting plate 22 by a fastener 142 to permit its free rotation. Slot 145 slidingly engages a second fastener 146 affixed to and projecting from the surface of member 32. Slide plates 141 fix the rotatable portion 90 in relation to mounting plate 22 in the second angularly displaced position shown in FIGS. 13 and 16, in phantom.

Rotatable portion 90 is preferably locked in the intermediate position and pivotally rotated to the second position by depressing release button 43 to disengage locking mechanism 190 from engagement with exterior housing member 32 and range-limiting device 140. Rotatable portion 90 can then pivotally rotate rearward about joint 160, between the intermediate position and the towing position of handle assembly 20. In the towing position, leg member 34 locking mechanism 190 engages exterior housing member 32 in fixed relation. Locking mechanism 190 includes a plug 191 having biased detents 192. Detents 192 engage slide frame 141 and exterior member 32 to lock rotatable portion 90 of handle assembly 20 in the intermediate position and the angularly displaced tilted position in this preferred embodiment.

As shown in FIGS. 11 and 14, interior housing member 35, exterior member 32 and joint 160 provide an uninterrupted path for the free sliding translation of leg member 34 so that leg 34 can pass through the interface of joint 160 with interior member 35 and exterior member 32 without interruption whether detents 192 are engaged or disengaged.

Joint 160 includes a first portion 161 rotatingly connected to a second portion 164 by pins 166. First portion 161 includes a base 163 that defines an aperture 165 and second portion 164 defines an aperture 167. Base 163 is connected to mounting plate 22. Apertures 165 and 166 at least receive and accommodate the sliding translation of leg member 34 when exterior housing member 32, aperture 165 and aperture 166 of joint 160 are aligned as in the first stowed position and the intermediate position. Joint 160 can pivot to the angular limit defined by range-limiting device 140 in the rearward direction from the axis defined by exterior member 32 and leg member 34 in the first and intermediate position.

Interior member 35 is connected to first portion 161 and exterior member 32 is connected to second portion 164. Base 163 also defines a stop to limit the rotation of rotatable portion 90, preferably at an approximately vertical position that is aligned with interior member 35.

Joint 160 can be any type of pivot or hinge that can support the pivotal movement of rotatable portion 90 of handle 30. For example, in one alternative embodiment of joint 160, exterior housing member 32 includes a flexible or living hinge that connects interior member 35 and exterior member 32 and supports the rotational movement of rotatable portion 90. The flexible hinge 160 can be integrally formed with exterior member 32 as a weakened portion for bending or an integrally connected assembly. In still another alternative embodiment of joint 160, interior housing member 35 and exterior member 32 are connected, e.g., by pins for rotation.

As illustrated in this preferred embodiment, handle assembly 20 has a single leg member 34 and associated exterior member 32 connecting to handgrip 36. It is understood, however, that handle assembly 20 as described herein includes alternative embodiments having two or more elements connecting to handgrip 36, including two or more exterior housing members 32 each having members 34.

It is also understood that this disclosure encompasses the reversal of the telescoping relationship of exterior member 32 and leg member 34, whereby member 32 is a single interior tubular member and leg 34, for example, has one or two members connected by joint 160. Similarly, the telescoping relationship as defined herein includes any form of sliding members, whether those members are co-axial or independently positioned and connected by a common housing or frame.

Referring now to FIGS. 11 and 15, handle assembly 20 is shown with the end of leg member 34 positioned at a lower limit of travel of interior member 35 and in proximity to bracket 130. It is to be understood that interior member 35 can be an optional member in that mounting plate 22 and/or joint 160 can extend down the exterior of case 10 to include apertures 38 and bracket 130 which can also be connected in any structurally sufficient manner to case 10, for example. Detents 192 of interior telescoping member 34 are shown disengaged in this illustration from apertures 38 of member 35.

Locking mechanism 190 of leg member 34 includes release button 43, a plug 191, a lower plug 195 and an actuator 198. Release button 43 is connected to lower plug 195 by actuator 198. Plug 191 is fixedly connected inside of, and in proximity to the first end of leg member 34. Plug 191 defines a channel and a detent axis of movement transverse to the longitudinal axis of leg member 34 for the sliding of two biased detents 192. A bias member 193 is preferably positioned in the channel to urge detents 192 outwardly. Lower plug 195 engages and repositions detents 192 between the engaged and disengaged position against biasing member 193.

Detents 192 engage member 32, member 35 and range-limiting device 140 with leg member 34 to lock handle assembly 20 in the stowed, intermediate and/or towing positions. Detents 192 are constructed to withstand the shearing forces between leg member 34 and member 32, member 35 and range-limiting device 140 to include the ability to independently sustain the loads to lift case 10 using handle assembly 20 in any position. Detents 192 are shown as cylindrical, but detents 192 can be any shape and are preferably received in correspondingly shaped apertures in handle 30. Detents 192 have tips that are preferably rounded or tapered to facilitate their engagement when extended in the engaged position or disengaged position.

Detents 192 are urged outwardly from plug 191 along the detent axis by centrally positioned biasing member 193 in this preferred embodiment. Biasing member 193 is shown as a coil spring, but it is understood that biasing member 193 can be a leaf spring or other flexible material that is biased in a direction towards the opposing portions of the tubular wall of leg member 34. A further alternative embodiment of biasing member 193 includes, for example, an elastic band that is connected to detents 192 and on opposing ends to the adjacent tubular wall of leg member 34 that biases detents 192 in an outward direction.

Detents 192 in the engaged position extend from the opposing sides of plug 191 and the tubular wall of leg member 34 a predetermined distance along the detent axis. When the detent axis is aligned with apertures 38 defined in member 35 and aperture 39 in member 32, for example, detents 192 extend at least through members 32 and 35. Detents 192 have an opposing end and have one or more walls defining a receptacle or interface 194 for lower plug 195.

Release button 43 is connected to lower plug 195 by actuator 198. Lower plug 195 includes a downward extension 196 having tapered edges 197 that engage one or more of the sidewalls of receptacles 194 in detents 192. Lower plug 195 is positioned in spaced relation with plug 191 so that when button 43 is actuated from the first position to the second depressed position, the tapered inner edges 197 engage and drive the sidewalls of receptacles 194 in an inward direction along the detent axis displacing each detent 192 from the engaged position to the disengaged position. The inward displacement and disengagement of detents 192 has sufficient force to override the outwardly directed force of biasing member 193 so that the tip of detent 192 is withdrawn to be at least approximately flush with the edge of the tubular wall of leg member 34.

In an alternative embodiment, detents 192 can be monolithically formed in the tubular wall of member 34 and biased to extend outward for engagement with member 32 and range-limiting device 140. Detents 192 in this embodiment can also include a monolithicaly formed or integrally connected wall at least partially defining receptacle 194 for engaging and receiving lower plug 195. Lower plug 165 in this embodiment can similarly retract detents 192 along the detent axis within the outer surface of the tubular wall of member 34.

Figure 13A:
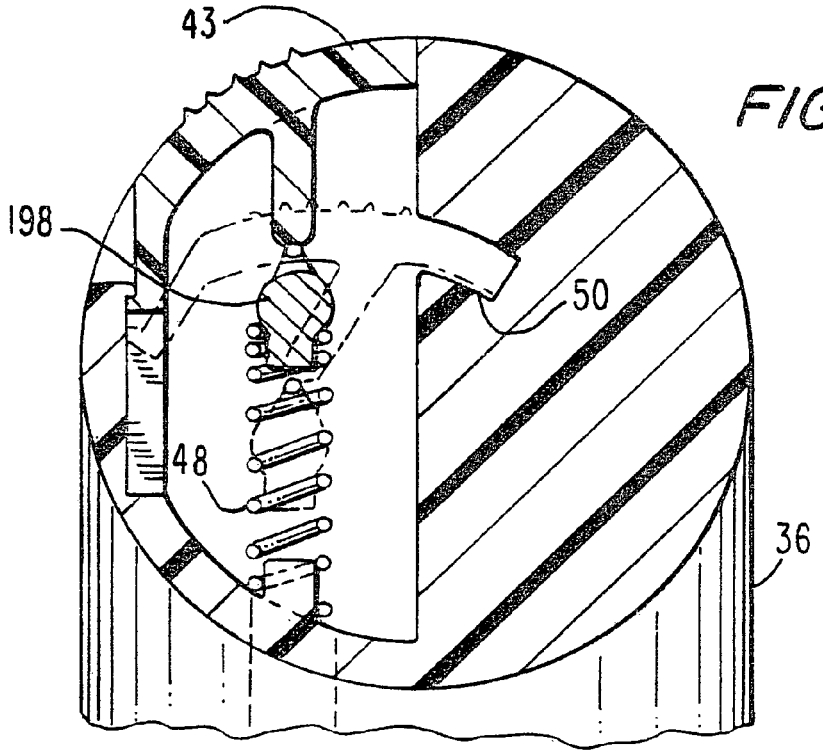
FIG. 13A is a side cross-sectional view, partly in phantom, taken along lines 12*a*—12*a* of FIG. 13 illustrating a release mechanism in the handgrip of the handle assembly.

As shown in FIGS. 13 and 13*a*, release button 43 is manually movable between the first extended position and the second depressed position for engaging actuator 198. A biasing member 48 returns button 43 to the first position upon being released in the second position. In one preferred embodiment, button 43 also includes a catch 50 that can engage release button 43 in handgrip 36 and retain it in a disengaged position without requiring the continuous manual depressing of release button 43 to maintain detents 192 in the disengaged position. Release button 43 can pivot in the forward direction in this embodiment in a depressed position to engage catch 50 on an inner lip of handgrip 36 such that release button 43 is movably secured in a depressed position. Button 43 can be released from catch 50 by pivoting in the rearward direction.

Catch 50 advantageously accommodates the uninterrupted movement of rotatable assembly 90 directly between the first stowed position and angularly displaced towing position, for example, without undesirably engaging locking mechanism 190 in one or more intermediate positions of handle assembly 20. It is understood that the catch 50 shown herein is a representation of a type of mechanism well known in the art and that alternative embodiments can include, for example, engaging projections, and receptacles.

As shown in FIGS. 12, 14 and 15, actuator 198 of locking mechanism 190 is preferably a rigid rod structure 199 including a first linear portion in tubular leg member 34 and a second portion in handgrip 36. As also shown in FIG. 15, the first linear portion is connected to lower plug 195. The second portion has an angular or "D" shaped rod that is positioned within, has a similar shape to handgrip 36 and is connected to release button 43. Rod 199 as defined herein can include any rigid structural element including tubes, bars, wire, and combinations thereof providing the structural rigidity to displace detents 192 at least against the force of biasing member 193 along the detent axis between the engaged and disengaged positions.

Actuator 198 is generally incompressible along the longitudinal axis of leg member 34 so that it preferably directly translates the displacement of release button 43 to vertically displace lower plug 195 a sufficient distance to engage and/or disengage detents 192. The interface of downward extension 196 of lower plug 195 and the walls of receptacles 194 are constructed so that the depression of release button 43 from the first extended position to the depressed position provides at least the minimal displacement to reposition detents 192 from the engaged position to the disengaged position. As required, locking mechanism 190 can also include assisting devices, such as a lever or linear actuator to extend the travel of, or add motive force to actuator 198 and/or lower plug 195.

In another preferred embodiment of locking mechanism 190, actuator 198 includes a sheathed flexible shaft 199 that extends from button 43 to lower plug 195. The sheath remains fixed within leg member 34 while flexible shaft 199 is displaced by the movement of button 43 between the first extended position and the second depressed position for the repositioning of detents 192 between the engaged and disengaged positions. Button 43 can also be a switch, for example, or other manual mechanism that functions to displace actuation mechanism 198, such as a slidable button along hand grip 36 that actuates a lever for the movement of actuator 198.

Figure 17:
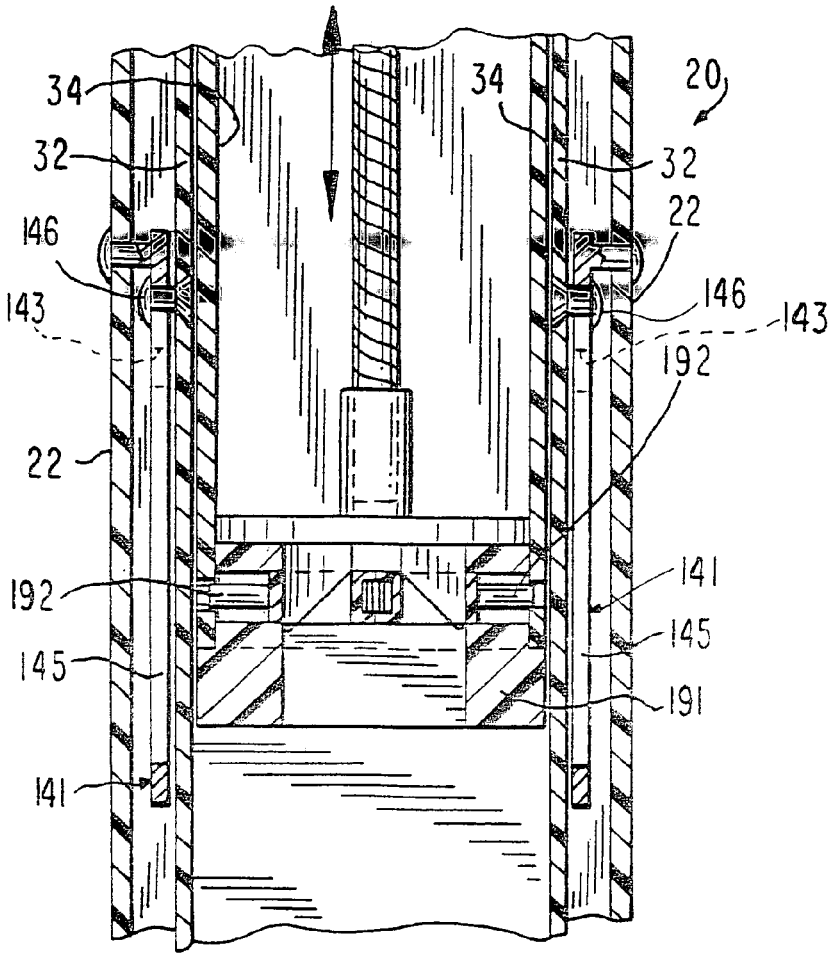
FIG. 17 is a rear elevation cross-sectional view taken along lines 17—17 of FIG. 12 showing the lower end of the leg member passing through a portion of the exterior housing member.

Referring now to FIGS. 16 and 17, leg member 34 is shown in an intermediate position and withdrawn from member 35 to engage detent 192 with member 32 aperture 39 and slide frame 141. Slide frame 141 is preferably flat to minimize the space required to accommodate its movement between the mounting plate 22 and member 32. Other devices known to the art can be utilized with appropriate modifications.

Slide frame 141 includes fastener 142, a first aperture 143, a second aperture 144 and a slot 145 having a fastener 146. Fastener 142, positioned in proximity to a section of slide frame 141, rotatably connects slide frame 141 to mounting plate 22. Slot 145 extends at least substantially along the length of elongated slide frame 141. Fastener 146 connects exterior member 32 to slide frame 141 through slot 145 for the sliding and pivotal rotation of exterior member 32 and leg member 34. Apertures 143 and 144 receive detents 192 and are positioned in slide frame 141 second end and a first free end, respectively. Apertures 143 and 144 lock rotatable portion 90 in the intermediate and angularly displaced towing positions, respectively.

When handle assembly 20 is in the extended position, apertures 143 in member 34 are aligned with apertures 39 of exterior member 32 and detents 192 engage apertures 39 and 143 and lock rotatable portion 90 in a fixed position relative to mounting plate 22 and case 10.

Figure 18:
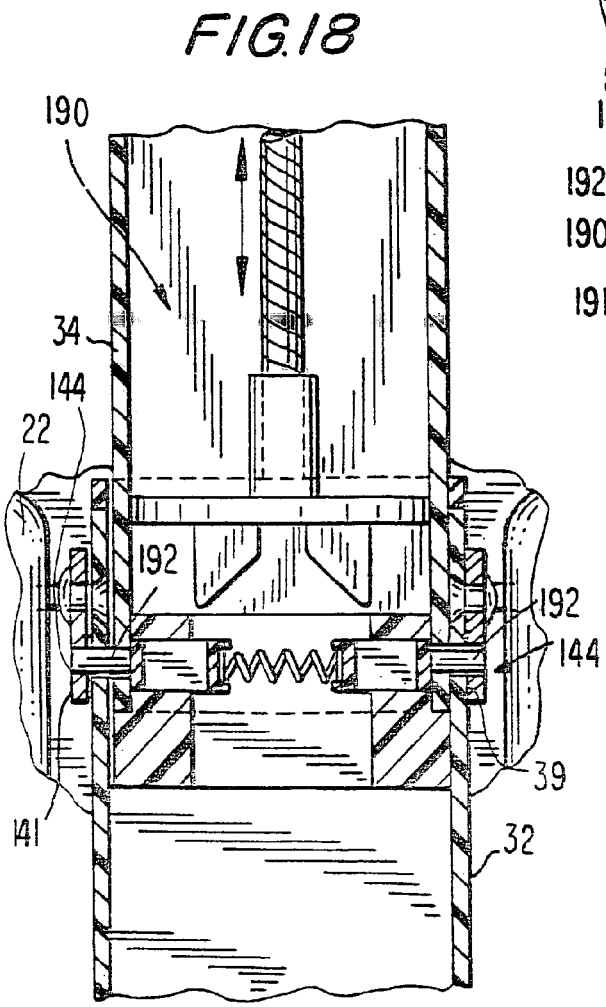
FIG. 18 is a rear elevation view, partly in cross-section, taken along lines 18—18 of FIG. 13 showing the locking mechanism engaged in the fully extended position of the handle.

As shown in FIGS. 13 and 18, the position of fastener 142 on mounting plate 22 for the rotation of slide frame 141 and the length of slot 145 define the limit of movement of rotational portion 90 about joint 160. Release button 43 is depressed to the second position to disengage detents 192 for the pivotal rotation of rotatable portion 90 approximately 35° from the intermediate position to the towing position of handle assembly 20. When rotatable portion 90 is positioned at the outer limit of travel in slot 145 in this embodiment, aperture 144 is aligned with aperture 39. Detent 192 has a sufficient bias and length, to extend through apertures 144 of slide frame 141 and thereby lock rotatable portion 90 in the angularly displaced position relative to case 10.

As has been shown in FIGS. 11–16, the operation of the presently described embodiment of the alternative means for limiting the range of movement of the pivoting handle 30 is illustrated. Handle assembly 20 is initially shown in the first position with portions of handle 30 in recess 21 of mounting plate 22. Leg member 34 and exterior housing member 32 are coaxial and telescoped. Detents 192 of locking mechanism 190 of leg member 34 are engaged with apertures 38 in interior member 35 and lock handle assembly 20 in the stowed position.

Handle 30 in the first stowed position within recess 21 advantageously provides the ability for a user to grasp handgrip 36 and conveniently provides one method to carry or roll case 10. Alternatively, handle 20 in the first position can be readily used to pick up or shift case 10 in an automobile trunk using handgrip 36.

Handle 30 is extended from the first stowed position by depressing release button 43 in handgrip 36 to disengage detents 192 from their biased extended position in apertures 38 of interior housing 35. Leg member 34 is then pulled along the axis defined by member 35 to extend from member 32. Detents 192 engage apertures 39 in member 32 and apertures 143 to lock leg 34 in the extended intermediate position along the vertical axis and prior to the rotation to the angularly displaced tilted position at about 35° from the vertical.

The intermediate position can be selectively used to advantageously push, tow or maneuver case 10 when desired.

Handle assembly 20 is moved between the intermediate position and the second angularly displaced position by actuating release button 43 to the second depressed position to disengage detents 192 from locking rotatable portion 90 in the intermediate position. Once detents 192 are disengaged, rotatable portion 90 can be rotated about joint 160. Fastener 142, positioned in proximity to the second end of slide frame 141, rotatingly connects slide frame 141 to mounting plate 22. The free first end of slide frame 141 rotates in the rearward direction from the intermediate position to the second angularly displaced position. As slide frame 141 rotates, fastener 146, positioned in slot 145 and connecting exterior member 32 to slide frame 141, slidingly pivots from an initial position in slot 145 to an outer end of slot 145. The outer end of slot 145 defines an angular limit of travel for fastener 46 that is approximately 35° from the axis defined by intermediate position.

When fastener 146 is at the outer angular limit of slot 145, apertures 144 are aligned with detents 192 to engage and lock slide frames 141, exterior member 32, leg member 34 and joint 160 of rotatable portion 90 in the second position of handle assembly 20. As described previously, this position of handle assembly 20 provides a comfortable method for towing, pushing and/or lifting case 10.

Handle assembly 20 is returned to the stowed position from the second position by depressing button 43 and aligning leg member 34 and exterior housing member 32 for sliding leg member 34 into the first stowed position. The intermediate position can be engaged or bypassed. When the detent axis of leg 34 is aligned with apertures 38 in member 35, detents 192 engage and lock handle assembly 20 in the first position.

While handle assembly 20 has been described as moving between the stowed position to the intermediate position and then to the angularly displaced position, handle assembly 20 can also move directly between the first position and the second position. For example, once the first lower end of leg 34 clears joint 160, it can be pivoted directly to the second position.

Detents 192 are positioned, sized and/or shaped to not interfere with range-limiting device 140 during the movement of rotatable portion 90 between the stowed, intermediate and/or towing positions. For example, detents 192 are preferably dimensioned so that slot 145 has a narrower width than the diameter of detents 192. Similarly, the tapering or rounding of the tips of detents 192 accommodates and facilitates the disengagement of the engaged detents 192 when the outer perimeter or edges of slide frame 141 contact detents 192 as slide frame 141 rotates into the second position from the intermediate position. Detents 192 retain the bias for being in locking engagement with rotational portion 90 when the detent axis is aligned with apertures 39 and 144. Handle assembly 20 is ruggedly constructed for the lifting or movement of case 10 by handle 30 in any position.

It is understood that additional apertures for detents 192 can be positioned in exterior member 32 to include additional detents in leg member 34 so that members, 32, 35 and 34 can remain aligned with the vertical axis and leg 34 can lock in multiple positions with exterior housing member 32.

This provides a convenient alternative way to reposition or maneuver case 10 a short distance around objects, or up and down stairs. Leg member 34 in this embodiment also retains the structural integrity to pull or lift case 10.

It is also to be understood that range-limiting device 140 can include variations of slide frames 141 that provide a range-limiting function for handle assembly 20 at approximately 35° and additional angular positions, if desired. In one alternative embodiment, slide frame 141 includes a plurality of apertures in proximity to slot 145 to fix handle 30 at additional angles from the vertical, such as about 15° and about 50° from the intermediate position. In another embodiment, the outer limit of slot 145 intersects with another slot defining an arc about fastener 142 having apertures to lock rotatable portion 90 at various angular positions. These additional embodiments can provide valuable alternative positions for handle 30 for the maneuvering of case 10 to accommodate exceptionally tall or short people, handicapped persons and/or movement up or down inclined or stepped surfaces.

The preferred embodiments described illustrate the inclined handle assembly mounted on the rear wall of the case, thereby allowing movement in the two co-linear directions parallel to the side walls 17 of the case. It should be understood that an inclined handle can also be mounted on either side wall 17 of the case, thereby allowing the case to be wheeled in either of the two co-linear directions parallel to the rear wall 16 of the case, provided that the case is fitted with appropriate and properly placed wheels. This latter embodiment would include the use of at least one caster wheel that is mounted to swivel in response to the directional force applied to move the case.

It should be clear to those of ordinary skill in the art that further modifications and embodiments of the present invention can be made and that the scope of the invention is to be determined by the following claims.

I claim:

1. A pivoting handle assembly (20) for use with a towed wheeled luggage case (10), the assembly comprising:

a mounting plate (22) for receiving and retaining a handle (30), the mounting plate (22) adapted for attachment to a wall of the case (10) above the wheels;

the handle (20) including an exterior housing member (32) and an extendable leg member (34) slidingly supported by and extending through the exterior housing member (32) in a stowed position, the leg member (34) having an upper end terminating in a handgrip (36);

pivotal mounting means connected to a lower end of the exterior housing member (32), the pivotal mounting means being secured to the mounting plate (22), wherein the exterior housing member (32) and the leg member (34) are coaxially aligned and rotatable about the mounting means between the stowed position and an angularly displaced towing position, at least one range-limiting device (140) operatively joined to and extending between the mounting plate (22) and the exterior housing member (32), wherein the angle between the handle (30) and case (10) wall when the handle (30) is in the towing position is determined by the range-limiting means, wherein said leg member (34) is coaxially aligned with the exterior housing member (32) when extended therefrom in the towing position, and wherein a lower end of the leg member (34) is located inside the case (10) in the stowed position.

2. The pivoting handle assembly (20) of claim 1, wherein the pivoting handle (30) has an intermediate extended position that is parallel to the wall on which the mounting plate (22) is attached.

3. The pivoting handle assembly of claim 2 which further comprises an interior housing member (35) for receiving the lower end of the leg member (34) in the stowed position.

4. The pivoting handle assembly (20) of claim 1, wherein the handle (30) includes a locking mechanism (190).

5. The pivoting handle assembly (20) of claim 4, wherein the locking mechanism (190) includes biased detents (192).

6. The pivoting handle assembly (20) of claim 1, wherein the at least one range-limiting (140) device includes apertures to engage detents (192) extending from the handle (30) to thereby releasably lock the handle (30) in a fixed position.

7. The pivoting handle assembly (20) of claim 1, wherein the at least one range-limiting means includes a slot (145) that receives in sliding relation a projecting member attached to the exterior housing member (32).

8. A pivoting handle assembly (20) for use with a piece of wheeled luggage (10), the assembly comprising:

a mounting plate (22) for receiving and retaining a handle (30) in pivotally-mounted relation, the mounting plate (22) adapted for attachment to a surface of the case (10), the handle (30) including an exterior housing member (32) and a leg member (34) having at least a lower end slidingly engaged coaxially with the exterior housing member (32), the leg member (34) including an upper end forming a handgrip (36), the exterior housing member (32) connected to pivotal mounting means, the pivotal mounting means (160) being connected to the mounting plate (22); and a rotatable portion (90) comprising the leg member (34) and exterior member (32), the pivotal mounting means and a range-limiting means connecting the rotatable portion (90) to the mounting plate (22), the rotatable portion (90) being pivotally movable between a stowed position and an angularly displaced towing position (T), wherein the angle defined between the leg member (34) of the handle (30) in the stowed position and the towing position is determined by the range-limiting means, wherein said leg member (34) is coaxially aligned with the exterior housing member (32) when extended therefrom in the towing position, and wherein the lower end of the leg member (34) is located inside the case (10) in the stowed position.

9. The pivoting handle assembly (20) of claim 8 wherein the handle (30) includes a locking mechanism (190) comprising at least one detent (192) biased to engage fixed apertures to thereby lock handle (30) in at least the stowed and towing positions.

10. The pivoting handle assembly (20) of claim 9, wherein the locking mechanism (190) includes at least two detents (192) extending in opposed directions.

11. The pivoting handle assembly (20) of claim 9, wherein the locking mechanism (190) includes an actuator (198) operatively connected to a manual release element (43) in the handgrip (36) and a lower plug (195) that engages the at least one detent (192), whereby moving the release element (43) results in movement of the detent (192) from an engaged position to a disengaged position.

12. The pivoting handle assembly (20) of claim 11, wherein the locking mechanism (190) includes a catch (50) to releasably retain the release element (43) in a position, whereby the detent (192) remains in the disengaged position.

13. The pivoting handle assembly (20) of claim 8 wherein the locking mechanism (190) engages the at least one range-limiting device (140) to releasably lock the handle (30) in at least one angularly displaced towing position.

14. The pivoting handle assembly (20) of claim 13, wherein each of the at least one the range-limiting members includes apertures to receive the at least one detent to lock the handle (30) in position.

15. The pivoting handle assembly (20) of claim 8, wherein the handle (30) has an intermediate position in which leg member (34) is slidingly extended out of the exterior housing member (32) in a vertical direction.

16. The pivoting handle assembly (20) of claim 8, wherein the leg member (34) is releasably lockable in the stowed position.

17. The pivoting handle assembly (20) of claim 8, wherein the handle (30) is lockable in an intermediate extended position that is parallel to the back wall of the case.

18. A pivoting handle assembly (20) for use with a wheeled luggage case (10), the assembly comprising:

a mounting plate (22) for receiving and retaining a handle (30) in pivotally-mounted relation by a pivotal mounting means, the mounting plate (22) adapted for attachment to an exterior surface of the case (10), the handle (30) including an exterior housing member (32) slidingly engaged coaxially with at least a lower portion of an extendable leg member (34), the leg member (34) including an upper portion forming a handgrip (36), the pivotal mounting means being connected to the mounting plate (22); the exterior housing member (32) joined to the pivotal mounting means at its lower end;

a range-limiting member connecting the handle (30) to the mounting plate (22); and a locking mechanism (190) including biased detents and locking apertures for locking the handle (30) in at least a stowed and a towing position, the locking mechanism (190) including a release element (43) in the handgrip (36) operatively coupled to a lower plug (195), the movement of which plug (195) engages and disengages the detents (192) from the locking apertures, to thereby permit movement of the extended leg member (34) from the stowed position relative to the mounting plate (22) to an intermediate position wherein the leg member (34) is vertically extended from the exterior housing member (32) in a generally vertical position and thereafter to the towing position, wherein the leg member (34) pivots relative to the mounting plate (22), the pivotal movement of the handle (30) being limited by the range-limiting member, and wherein said leg member (34) is coaxially aligned with the exterior housing member (32) when extended therefrom in the towing position.

19. The pivoting handle assembly (20) of claim 18 which further comprises an interior housing member (35) positioned inside the case (10) for receiving at least a portion of the leg member (34), wherein the leg member (34) and the exterior and interior housing members (32, 35) are coaxially aligned.

20. A method of pivoting a handle assembly (20) of a wheeled luggage case (10), comprising the steps of:

providing a wall of the case (10) with a mounting plate (22) positioned above the towing wheels (22) and an extendable handle (30) attached to the mounting plate (22), the handle (30) having a pivoting portion (90), that includes a leg member (34) slidingly engaged coaxially in an exterior housing member (32);

extending the leg member (34) coaxially from said exterior housing member (32) and a predetermined distance from a first stowed position parallel to the wall, wherein a lower end of the leg member (34) is located inside the case (10) in the stowed position; and pivoting the rotatable portion (90) of the handle (30) between the extended position and a predetermined angularly displaced towing position, engaging and locking the handle (90) by movement of a range-limiting means that is joined to the mounting plate (22) and the rotatable portion of the handle (32), and wherein said leg member (34) is coaxially aligned with the exterior housing member (32) when extended therefrom in the towing position.

21. The method of claim 20, wherein the step of pivoting the handle (30) further comprises disengaging a locking mechanism (190) to permit the rotatable portion (90) to move between the stowed and towing positions.

* * * * *